US011624104B2

(12) United States Patent
Liu et al.

(10) Patent No.: US 11,624,104 B2
(45) Date of Patent: Apr. 11, 2023

(54) MULTICOMPONENT ALLOY COATING

(71) Applicant: INDUSTRIAL TECHNOLOGY RESEARCH INSTITUTE, Hsinchu (TW)

(72) Inventors: Wu-Han Liu, Miaoli (TW); Wei-Tien Hsiao, Zhudong Township (TW); Chang-Chih Hsu, Hsinchu (TW); Mao-Shin Liu, Hsinchu (TW); Zhong-Ren Wu, Taichung (TW); Shih-Hsiang Chou, Zhubei (TW); Chin-An Wang, Taipei (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 411 days.

(21) Appl. No.: 16/422,575

(22) Filed: May 24, 2019

(65) Prior Publication Data

US 2020/0208242 A1 Jul. 2, 2020

Related U.S. Application Data

(60) Provisional application No. 62/785,923, filed on Dec. 28, 2018.

(30) Foreign Application Priority Data

Jan. 17, 2019 (TW) ..... 108101774

(51) Int. Cl.
*C22C 19/05* (2006.01)
*C22C 32/00* (2006.01)
(Continued)

(52) U.S. Cl.
CPC ..... *C22C 19/05* (2013.01); *C22C 27/06* (2013.01); *C22C 30/00* (2013.01); *C22C 32/00* (2013.01);
(Continued)

(58) Field of Classification Search
CPC ..... C22C 19/05; C22C 32/00; C22C 19/058; C22C 32/0005; C22C 27/06; C22C 30/00;
(Continued)

(56) References Cited

U.S. PATENT DOCUMENTS 4,447,503 A * 5/1984 Dardi ..... C22C 19/00 428/632
6,199,281 B1 3/2001 Lee et al.
(Continued)

FOREIGN PATENT DOCUMENTS

CN 1498984 A 5/2004
CN 101052743 B 12/2010
(Continued)

OTHER PUBLICATIONS

CN-105908018-A: Espacenet English machine translation (Year: 2016).*
(Continued)

*Primary Examiner* — Keith Walker
*Assistant Examiner* — Adil A. Siddiqui
(74) *Attorney, Agent, or Firm* — Birch, Stewart, Kolasch & Birch, LLP

(57) ABSTRACT

A multicomponent alloy coating is provided. The multicomponent alloy coating includes a hard layer and a plurality of nickel-based particles dispersed in the hard layer. The composition of the multicomponent alloy coating is represented by the following formula (I):

$$Al_dCo_eCr_gFe_hNi_iSi_jC_kO_m \quad \text{formula (I)},$$

wherein $1<d<2$, $0.5<e<0.8$, $2<g<3.2$, $0.05<h<0.3$, $2<i<3$, $j=1$, $k\geq 0$, $m\geq 0$, and iron is present in the amount of less than 3 wt % of the composition of the multicomponent alloy coating.

11 Claims, 12 Drawing Sheets

(51) Int. Cl.

| | |
|---|---|
| ***C22C 27/06*** | (2006.01) |
| ***C22C 30/00*** | (2006.01) |
| ***C22C 1/05*** | (2023.01) |
| *C23C 4/067* | (2016.01) |
| *C23C 4/131* | (2016.01) |
| *C22C 1/053* | (2023.01) |
| *C23C 4/10* | (2016.01) |
| *C23C 4/129* | (2016.01) |
| *C23C 4/134* | (2016.01) |

(52) U.S. Cl.
CPC ..... *C22C 32/0005* (2013.01); *C22C 32/0052* (2013.01); *C22C 1/053* (2013.01); *C23C 4/067* (2016.01); *C23C 4/10* (2013.01); *C23C 4/129* (2016.01); *C23C 4/131* (2016.01); *C23C 4/134* (2016.01)

(58) Field of Classification Search
CPC ..... C22C 4/129; C22C 4/134; C22C 4/131; C22C 4/067; C22C 4/10; C22C 1/053; C22C 32/0052
See application file for complete search history.

(56) References Cited

U.S. PATENT DOCUMENTS

| | | | | |
|---|---|---|---|---|
| 9,441,267 | B2 | 9/2016 | Otobe et al. | |
| 2003/0098090 | A1* | 5/2003 | Hallen | C23C 26/02 148/242 |
| 2007/0292304 | A1* | 12/2007 | Wojcieszynski | C22C 1/1042 420/448 |
| 2011/0250463 | A1* | 10/2011 | Helander | B22F 3/02 428/544 |
| 2015/0284828 | A1* | 10/2015 | Otobe | F01L 3/04 251/366 |
| 2017/0100804 | A1* | 4/2017 | Goncharov | C22C 19/055 |
| 2018/0066343 | A1* | 3/2018 | Bengtsson | C22C 32/0052 |
| 2018/0179622 | A1* | 6/2018 | Taneike | C22C 1/02 |

FOREIGN PATENT DOCUMENTS

| | | | | | |
|---|---|---|---|---|---|
| CN | 102146563 | A | | 8/2011 | |
| CN | 103290402 | A | | 9/2013 | |
| CN | 103757514 | A | | 4/2014 | |
| CN | 103255414 | B | | 10/2015 | |
| CN | 105401042 | A | | 3/2016 | |
| CN | 105887082 | A | | 8/2016 | |
| CN | 105908018 | A | * | 8/2016 | B22F 1/0003 |
| CN | 105925869 | A | | 9/2016 | |
| CN | 105970132 | A | | 9/2016 | |
| CN | 104532231 | B | | 8/2017 | |
| CN | 107267843 | A | | 10/2017 | |
| CN | 107299342 | A | | 10/2017 | |
| CN | 108220857 | A | | 6/2018 | |
| EP | 0 291 589 | A1 | | 11/1988 | |
| TW | I278521 | B | | 4/2007 | |
| TW | 201734225 | A | | 10/2017 | |

OTHER PUBLICATIONS

Miracle et al., "A critical review of high entropy alloys and related concepts", Acta Materialia, vol. 122, 2017, pp. 448-511.
Yeh, "The Development of High-Entropy Alloys", Hua Kang Journal of Engineering Chinese Culture University, vol. 27, 2011, pp. 1-18, with partial English translation.
Taiwanese Office Action for Appl. No. 108101774 dated Oct. 18, 2019.

* cited by examiner

MULTICOMPONENT ALLOY COATING

CROSS REFERENCE TO RELATED APPLICATIONS

The present application is based on, and claims priority from U.S. Provisional Application No. 62/785,923, filed on Dec. 28, 2018, and Taiwan Application Serial Number 108101774, filed on Jan. 17, 2019, the disclosures of which are hereby incorporated by reference herein in its entirety.

TECHNICAL FIELD

The present disclosure relates to a multicomponent alloy coating.

BACKGROUND

Aluminum wheel rims have the advantages of being lightweight and having low energy consumption. Therefore, the use of aluminum wheel rims in vehicles for transportation of heavy loads, e.g., trucks and buses, has been gradually increased, so as to gradually replace the use of traditional iron wheel rims. However, as vehicles are travelling, the wheel rims tend to experience various unfavorable weather or terrain conditions, such as high temperature, silt, or wear and corrosion caused by moisture in the external environment or on the ground. These are all likely to cause damage to the wheel rims, and may result in reduced service lives of the wheel rims and increase the costs of maintenance and use of the vehicles.

In order to improve the service lives of the wheel rims and reduce the costs of maintenance and use, it is necessary to provide a protective coating on the surface of the wheel rims in order to reduce the wear and corrosion of the wheel rims. Therefore, industry has been devoted to the research and developments of protective coatings of wheel rims.

SUMMARY

The present disclosure is related to a multicomponent alloy coating. In the embodiments, when the elements in the composition of the multicomponent alloy coating satisfy the atomic ratio represented in formula (I), and iron is present in the amount of less than 3 wt % of the composition of the multicomponent alloy coating, the multicomponent alloy coating can be provided with good wear resistance and good toughness.

According to an embodiment of the present disclosure, a multicomponent alloy coating is provided. The multicomponent alloy coating includes a hard layer and a plurality of nickel-based particles dispersed in the hard layer. The composition of the multicomponent alloy coating is represented by the following formula (I):

$$Al_dCo_eCr_gFe_hNi_iSi_jC_kO_m \qquad \text{formula (I)},$$

wherein $1<d<2$, $0.5<e<0.8$, $2<g<3.2$, $0.05<h<0.3$, $2<i<3$, $j=1$, $k\geq 0$, $m\geq 0$, and iron is present in the amount of less than 3 wt % of the composition of the multicomponent alloy coating.

A detailed description is given in the following embodiments with reference to the accompanying drawings.

DETAILED DESCRIPTION

Figure 1A:
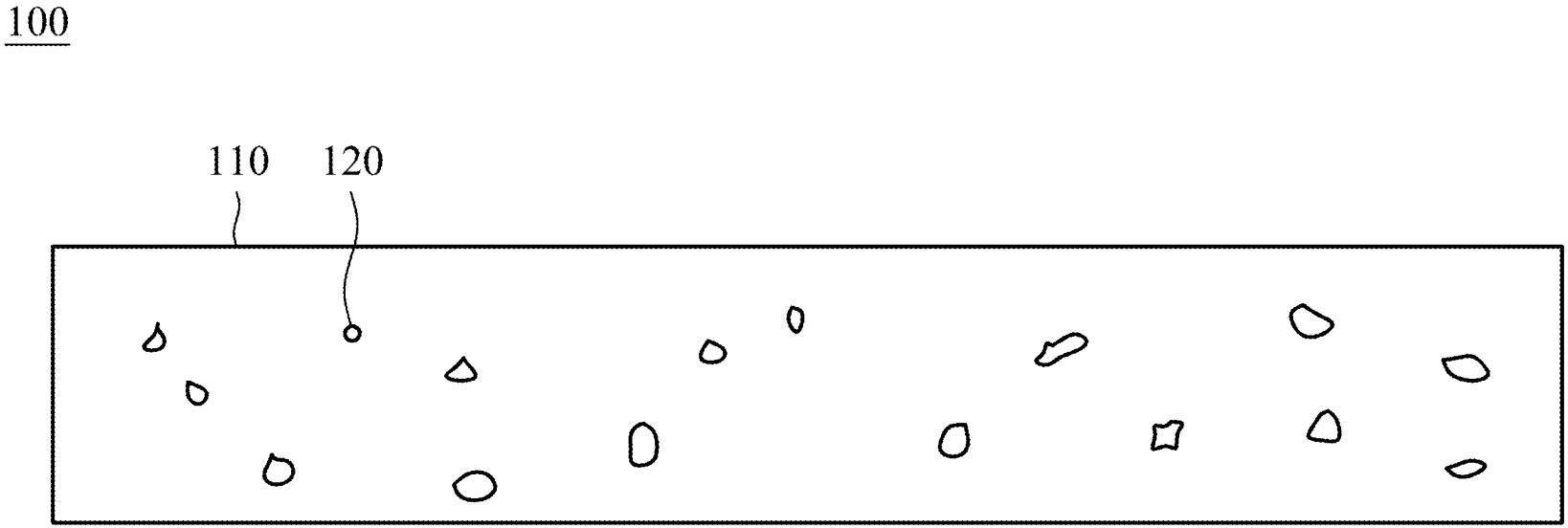
FIG. 1A is a schematic drawing of a multicomponent alloy coating according to an embodiment of the present disclosure.

In the embodiments of the present disclosure, when the elements in the composition of the multicomponent alloy coating satisfy the atomic ratio represented in formula (I), and iron is present in the amount of less than 3 wt % of the composition of the multicomponent alloy coating, the multicomponent alloy coating can be provided with good wear resistance and good toughness. Details of embodiments of the present disclosure are described hereinafter. Specific structures, compositions, and manufacturing processes disclosed in the embodiments are used as examples and for explaining the disclosure only and are not to be construed as limitations. A person having ordinary skill in the art may modify or change the structures, compositions, and manufacturing processes of the embodiments according to actual applications.

Unless explicitly indicated by the description, as used herein, the singular forms "a," "an" and "the" are intended to include the plural forms as well, unless the context clearly indicates otherwise. It should be further understood that when such as the term "includes" and/or "including," is used in this specification, it specifies the presence of described features, steps, operations, elements, and/or components, but does not preclude the presence or addition of one or more other features, steps, operations, elements, components, and/or groups thereof.

Throughout this specification, the term "one embodiment" or "an embodiment" means that a particular feature, structure, or characteristic described in connection with the embodiment is included in at least one embodiment. Thus, the phrases "in one embodiment" or "in an embodiment" in various contexts throughout this specification do not necessarily all refer to the same embodiment. Furthermore, the particular features, structures, or characteristics may be combined in any suitable manner in one or more embodiments. It should be appreciated that the following figures are not drawn to scale; rather, these figures are merely illustrations According to the embodiments of the present disclosure, a multicomponent alloy coating is provided. According to the embodiments of the present disclosure, the multicomponent alloy coating can be used as the protective coating of wheel rims, such as the protective coating of aluminum wheel rims of vehicles and motorcycles.

According to the embodiments of the present disclosure, the composition of the multicomponent alloy coating is represented by the following formula (I):

$$Al_dCo_eCr_gFe_hNi_iSi_jC_kO_m \quad \text{formula (I)}$$

wherein $1<d<2$, $0.5<e<0.8$, $2<g<3.2$, $0.05<h<0.3$, $2<i<3$, $j=1$, $k\geq 0$, $m\geq 0$, and iron is present in the amount of less than 3 wt % of the composition of the multicomponent alloy coating.

According to the embodiments of the present disclosure, when the elements in the composition of the multicomponent alloy coating satisfy the constituents and the atomic ratio represented in the above formula (I), and iron satisfies the above weight percentage, the multicomponent alloy coating can be provided with good wear resistance and good toughness.

In some embodiments, iron is present in the amount of such as greater than 2 wt % and less than 2.5 wt % of the composition of the multicomponent alloy coating. According to some embodiments of the present disclosure, the multicomponent alloy coating contains greater than 2 wt % and less than 2.5 wt % of iron, and thus despite the face that the multicomponent alloy coating of the present disclosure is not a typical high-entropy alloy, it is still provided with high hardness and high toughness comparable to that of high-entropy alloy.

In some embodiments, iron is present in the amount of such as less than 3 at % (atomic percent) of the composition of the multicomponent alloy coating. In some embodiments, iron is present in the amount of such as greater than 1 at % and less than 2 at % of the composition of the multicomponent alloy coating.

In some embodiments, nickel is present in the amount of such as greater than 30 wt % of the composition of the multicomponent alloy coating. According to some embodiments of the present disclosure, the multicomponent alloy coating contains greater than 30 wt % of nickel, such that it is advantageous to increasing the toughness of the multicomponent alloy coating.

In some embodiments, nickel is present in the amount of such as less than 35 at % of the composition of the multicomponent alloy coating. In some embodiments, nickel is present in the amount of such as greater than 15 at % and less than 25 at % of the composition of the multicomponent alloy coating.

In some embodiments, aluminum is present in the amount of such as greater than 9 wt % of the composition of the multicomponent alloy coating. According to some embodiments of the present disclosure, the multicomponent alloy coating contains greater than 9 wt % of aluminum, such that it is advantageous to increasing the toughness of the multicomponent alloy coating.

In some embodiments, in formula (I), $2.5<k<4$ and $0.05<m<0.5$. In other words, in some embodiments, in the composition of the multicomponent alloy coating, the atomic ratio of carbon to silicon is about greater than 2.5 to less than 4, and the atomic ratio of oxygen to silicon is about greater than 0.05 to less than 0.5.

In some embodiments, carbon is present in the amount of such as greater than 0 wt % and less than 9 wt % of the composition of the multicomponent alloy coating. In some embodiments, carbon is present in the amount of such as greater than 8 wt % and less than 9 wt % of the composition of the multicomponent alloy coating.

In some embodiments, oxygen is present in the amount of such as greater than 0 wt % and less than 9 wt % of the composition of the multicomponent alloy coating. In some embodiments, oxygen is present in the amount of such as greater than 0 wt % and less than 2 wt % of the composition of the multicomponent alloy coating.

In some embodiments, the composition of the multicomponent alloy coating may include amorphous carbide. For example, in the manufacturing process of the multicomponent alloy coating of the present disclosure, firstly, multicomponent alloy powders are made from a pre-made alloy mixture by such as a gas atomization process. Then, the multicomponent alloy powders are sprayed onto a substrate by such as a high velocity oxygen fuel (HVOF) process to form the multicomponent alloy coating. According to the embodiments of the present disclosure, it is not limited to utilizing a HVOF process to spray multicomponent alloy powders onto a substrate to form the multicomponent alloy coating. Other spray processes, such as a flame spray process, a plasma spray process, an arc spray process, and etc. may be used to form the multicomponent alloy coating of the present disclosure.

Carbon contained in the composition of the as-formed multicomponent alloy coating may be carbon impurity introduced when performing a HVOF process, and the carbon impurity further forms amorphous carbide. Carbide formed in this way does not have reinforcing phase properties. In other words, in some embodiments, the composition of the multicomponent alloy coating does not include crystalline carbide. For example, the composition of the multicomponent alloy coating does not include silicon carbide with high hardness, for example, crystalline silicon carbide.

In current technique, hard ceramic materials or crystalline carbide having high hardness, e.g. silicon carbide materials, are usually added into alloy materials as reinforcing material to increase the hardness of the alloy materials. In contrast, according to some embodiments of the present disclosure, the elements in the composition of the multicomponent alloy coating satisfy the atomic ratio represented in the above-mentioned formula (I), and iron satisfies the above weight percentage. Therefore, the multicomponent alloy coating can be provided with good wear resistance and good toughness without including reinforcing material such as crystalline carbide or the like.

In some embodiments, the composition of the multicomponent alloy coating may be substantially free from niobium (Nb).

In some embodiments, the composition of the multicomponent alloy coating may be substantially free from copper (Cu).

In some embodiments, the composition of the multicomponent alloy coating may be substantially free from manganese (Mn).

In some embodiments, the composition of the multicomponent alloy coating may be substantially free from manganese (Mn).

In some embodiments, the composition of the multicomponent alloy coating may be substantially free from boron (B).

In some embodiments, the composition of the multicomponent alloy coating may be substantially free from molybdenum (Mo).

In some embodiments, the composition of the multicomponent alloy coating may be substantially free from titanium (Ti).

It is to be noted that a person having ordinary skill in the art should understand that due to the selections of the starting materials of each element, in addition to the predetermined elements and the weight percentages thereof, the composition of the prepared multicomponent alloy coating may further include trace amounts of other impurity elements originally existed in the starting materials. In other words, in some embodiments, the multicomponent alloy coating of the present disclosure may include very trace amounts of the above-mentioned Nb, Cu, Mn, W, B, Mo, and/or Ti from the impurities in the starting materials.

In some embodiments, the multicomponent alloy coating has a porosity of such as 0.1%-2%. In some embodiments, the multicomponent alloy coating has a porosity of such as 0.1%-1%. For example, in some embodiments, the multicomponent alloy coating coated on an aluminum substrate has a porosity of such as 1.04%, the multicomponent alloy coating coated on a 304 stainless steel substrate has a porosity of such as 0.78%, and the multicomponent alloy coating coated on an Inconel 718 nickel-based alloy substrate (No. In718) has a porosity of such as 0.89%.

In some embodiments, the multicomponent alloy coating has a Vickers hardness of about 680 $Hv_{0.1}$ to 800 $Hv_{0.1}$. For example, in some embodiments, the multicomponent alloy coating coated on an aluminum substrate has a Vickers hardness of about 757.4±159 $Hv_{0.1}$, the multicomponent alloy coating coated on a 304 stainless steel substrate has a Vickers hardness of about 745.2±120 $Hv_{0.1}$, and the multicomponent alloy coating coated on an Inconel 718 nickel-based alloy substrate has a Vickers hardness of about 653.8±126 $Hv_{0.1}$.

In some embodiments, the multicomponent alloy coating has a thickness of about 50 μm to about 500 μm.

According to the embodiments of the present disclosure, the multicomponent alloy coating may be formed on an aluminum-based substrate, a cobalt-based substrate, a nickel-based substrate, and/or a copper-based substrate. For example, the multicomponent alloy coating of the embodiments of the present disclosure may be formed on the aforementioned substrates by a thermal spray process, and the as-formed coating has good coating properties.

Figure 1B:
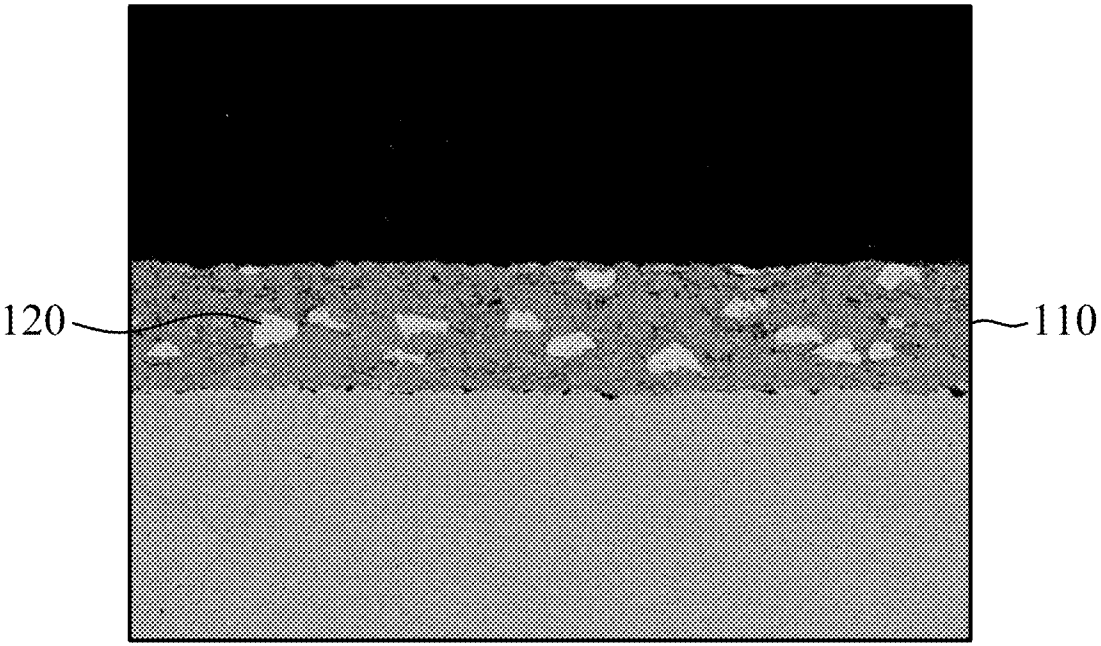
FIG. 1B is a SEM image of a multicomponent alloy coating according to an embodiment of the present disclosure.

FIG. 1A is a schematic drawing of a multicomponent alloy coating 100 according to an embodiment of the present disclosure, and FIG. 1B is a SEM image of a multicomponent alloy coating according to an embodiment of the present disclosure.

In some embodiments, as shown in FIGS. 1A-1B, the structure of the multicomponent alloy coating 100 may further include a hard layer 110 and nickel-based particles 120 dispersed in the hard layer 110.

In some embodiments, a weight ratio of the hard layer 110 with respect to the nickel-based particles 120 is such as 65:35 to 90:10.

In some embodiments, the nickel-based particles 120 are present in the amount of such as greater than 9 vol. % of the multicomponent alloy coating 100.

In some embodiments, the composition of the hard layer 110 may be represented by the following formula (II):

$$Al_{d1}Co_{e1}Cr_{g1}Fe_{h1}Ni_{i1}Si_{j1}C_{k1}O_{m1} \quad \text{formula (II)}$$

wherein $0<d1<2$, $0.5<e1<0.8$, $2<g1<6$, $0.05<h1<0.3$, $2<i1<3$, $j1=1$, $2<k1<4$, and $0.1<m1<0.7$.

According to some embodiments of the present disclosure, the hard layer 110 has the composition represented by the above formula (II) and thus has high hardness and good wear resistance.

In some embodiments, chromium is present in the amount of such as greater than 50 wt % of the composition of the hard layer 110. In some embodiments, chromium is present in the amount of such as greater than 55 wt % of the composition of the hard layer 110.

According to some embodiments of the present disclosure, the hard layer 110 contains greater than 50 wt % of chromium, or greater than 55 wt % of chromium. Therefore, it is advantageous to increasing the hardness and wear resistance of the hard layer 110, thereby the multicomponent alloy coating 100 can be provided with excellent wear resistance.

In some embodiments, the composition of the nickel-based particles 120 may be represented by the following formula (III):

$$Al_{d2}Ni_{i2}C_{k2}O_{m2} \quad \text{formula (III)}$$

wherein $0<d2<0.007$, $i2=2$, $0.3<k2<0.4$, and $0.01<m2<0.02$.

According to some embodiments of the present disclosure, the nickel-based particles 120 have the composition represented by the above formula (III), such that the nickel-based particles 120 dispersed in the hard layer 110 can increase the toughness of the multicomponent alloy coating 100.

In some embodiments, nickel is present in the amount of such as greater than 85 wt % of the composition of the nickel-based particles 120. In some embodiments, nickel is present in the amount of such as greater than 90 wt % of the composition of the nickel-based particles 120.

According to some embodiments of the present disclosure, the nickel-based particles 120 contain greater than 85 wt % of nickel, or greater than 90 wt % of nickel. The nickel-based particles 120 have relatively high toughness, therefore, the nickel-based particles 120 dispersed in the hard layer 110 can render the multicomponent alloy coating 100 having excellent wear resistance as well as toughness.

In some embodiments, carbon is present in the amount of such as greater than 4 wt % of the composition of the nickel-based particles 120. In some embodiments, carbon is present in the amount of such as greater than 5 wt % of the composition of the nickel-based particles 120.

Further explanation is provided with the following embodiments of the present disclosure. Compositions and properties of multicomponent alloy coatings of embodiments and coatings of comparative embodiments are listed for showing the properties of multicomponent alloy coatings according to the embodiments of the present disclosure. However, the following embodiments are for purposes of describing only, and are not intended to be limiting the scope of the present disclosure.

The composition of the multicomponent alloy coating of embodiment 1 (E1) is listed in table 1. The ratio of each element present in the overall coating is represented by weight percent (wt %) and atomic percent (at %). The atomic ratios between elements are listed as well.

TABLE 1

| | Multicomponent alloy coating | | | Hard layer | | | Nickel-based particles | |
|---|---|---|---|---|---|---|---|---|
| | wt % | at % | Atomic ratios | wt % | at % | Atomic ratios | wt % | at % |
| C | 8.46 | 26.15 | 3.54 | 5.11 | 17.27 | 2.17 | 5.15 | 20.78 |
| O | 1.15 | 2.67 | 0.36 | 2.10 | 5.33 | 0.67 | 0.31 | 0.92 |
| Al | 10.08 | 13.88 | 1.88 | 4.76 | 7.17 | 0.90 | 0.25 | 0.46 |
| Si | 5.59 | 7.39 | 1.00 | 5.50 | 7.95 | 1.00 | 0 | 0 |
| Cr | 31.67 | 22.63 | 3.06 | 57.76 | 45.11 | 5.67 | 0 | 0 |
| Fe | 2.09 | 1.39 | 0.19 | 1.62 | 1.18 | 0.15 | 0 | 0 |
| Co | 9.09 | 5.73 | 0.78 | 8.00 | 5.51 | 0.69 | 0 | 0 |
| Ni | 31.87 | 20.16 | 2.73 | 15.15 | 10.48 | 1.32 | 94.29 | 77.84 |

The composition of the multicomponent alloy coating of comparative embodiment 1 (C1) is listed in table 2. The ratio of each element present in the overall coating is represented by atomic percent (at %).

TABLE 2

| | Al | Co | Cr | Fe | Ni | Si | Mo |
|---|---|---|---|---|---|---|---|
| at % | <0.5 | greater than 0.5 and lower than 1 | greater than 0.7 and less than 1 | greater than 0.6 and less than 1 | 1 | 0 | greater than 0.4 and less than 0.7 |

Comparative embodiment 2 (C2) is a metal oxide-containing cobalt-based four-component alloy coating made from CoCrAlY/aluminum oxide ($Al_2O_3$) powders by a HVOF process. Comparative embodiment 3 (C3) is a carbide-containing alloy coating made from $Cr_3C_2$—NiCr/SiC—Ni powders by a HVOF process. Comparative embodiment 4 (C4) is bulk aluminum metal. Comparative embodiments 7-I to 7-III (C7-I to C7-III) are six-component (FeNiCoCrAlSi) alloy bulks having atomic ratios different from that of embodiment 1 (E1), and each element is present in the amount of 3-35 wt %. Among these three comparative embodiments, comparative embodiment 7-I has the highest aluminum content, comparative embodiment 7-II has the second highest aluminum content, and comparative embodiment 7-III has the lowest aluminum content.

Falling sand wear tests were performed on embodiment 1 (E1) and comparative embodiments 1 to 4 and 7-I to 7-III (C1 to C4 and C7-I to C7-III). The applied force was 13 Newton (Nt), and the falling sand speed was 300-400 g/min. The thicknesses of the coatings E1, C1 to C3, and C7-I to C7-III coated on a substrate are all 200 μm, and C4 is bulk aluminum metal. Please refer to FIGS. 2A-2B, which show the relationships between weight loss and heat-treatment time of coatings according to the embodiment and comparative embodiments of the present disclosure.

Figure 2A:
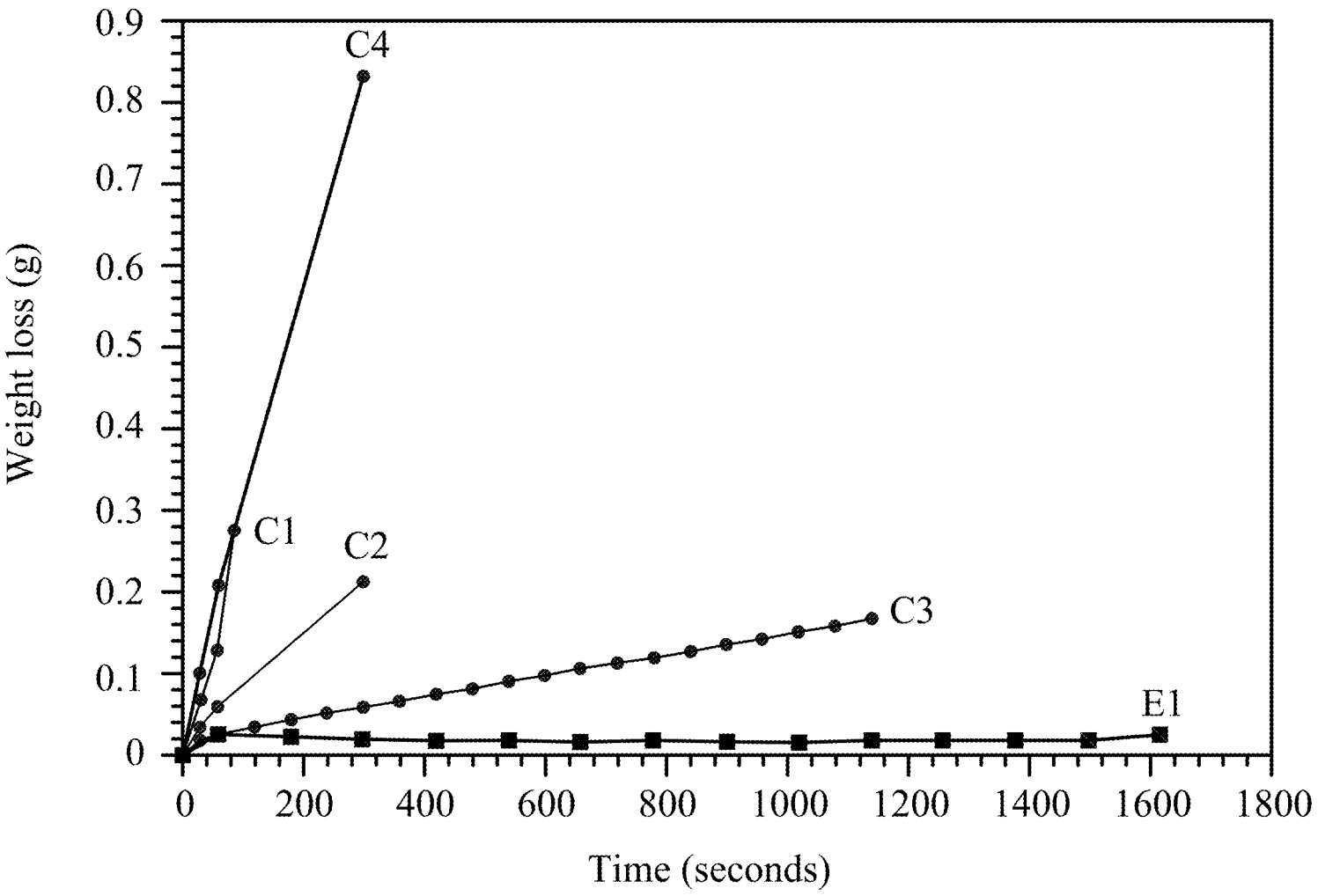
FIG. 2A to FIG. 2B show the relationships between weight loss and heat-treatment time of coatings according to an embodiment and some comparative embodiments of the present disclosure.

As shown in FIG. 2A, the composition and ratios of elements of the six-component alloy coating of comparative embodiment 1 (C1) are different from those of the embodiments of the present disclosure. For example, the six-component alloy coating of comparative embodiment 1 (C1) includes molybdenum but not include silicon, and the time of abrasion until exposing the substrate is the shortest, which is merely about 90 seconds. In addition, the volume lost by abrasion of comparative embodiment 1 (C1) is as high as 57.15-63.84 $mm^3$, indicating that the six-component alloy coating of comparative embodiment 1 (C1) has a relatively poor wear resistance.

As shown in FIG. 2A, for the bulk aluminum metal of comparative embodiment 4 (C4), the time of abrasion until failing to keep abrading is merely 290 seconds. It shows that bulk aluminum metal inherently has poor wear resistance.

As shown in FIG. 2A, for the metal oxide-containing cobalt-based four-component alloy coating of comparative embodiment 2 (C2), the time of abrasion until exposing the substrate is pretty short, which is merely about 300 seconds. It shows that the metal oxide-containing cobalt-based four-component alloy coating still has poor wear resistance.

As shown in FIG. 2A, for the carbide-containing four-component alloy coating of comparative embodiment 3 (C3), although the time of abrasion until exposing the substrate shows a better result that of comparative embodiment 2 (C2), it is still merely about 1140 seconds. This indicates that the four-component alloy coating still fails to provide good wear resistance, even with the addition of reinforcing materials (e.g. carbide).

Figure 2B:
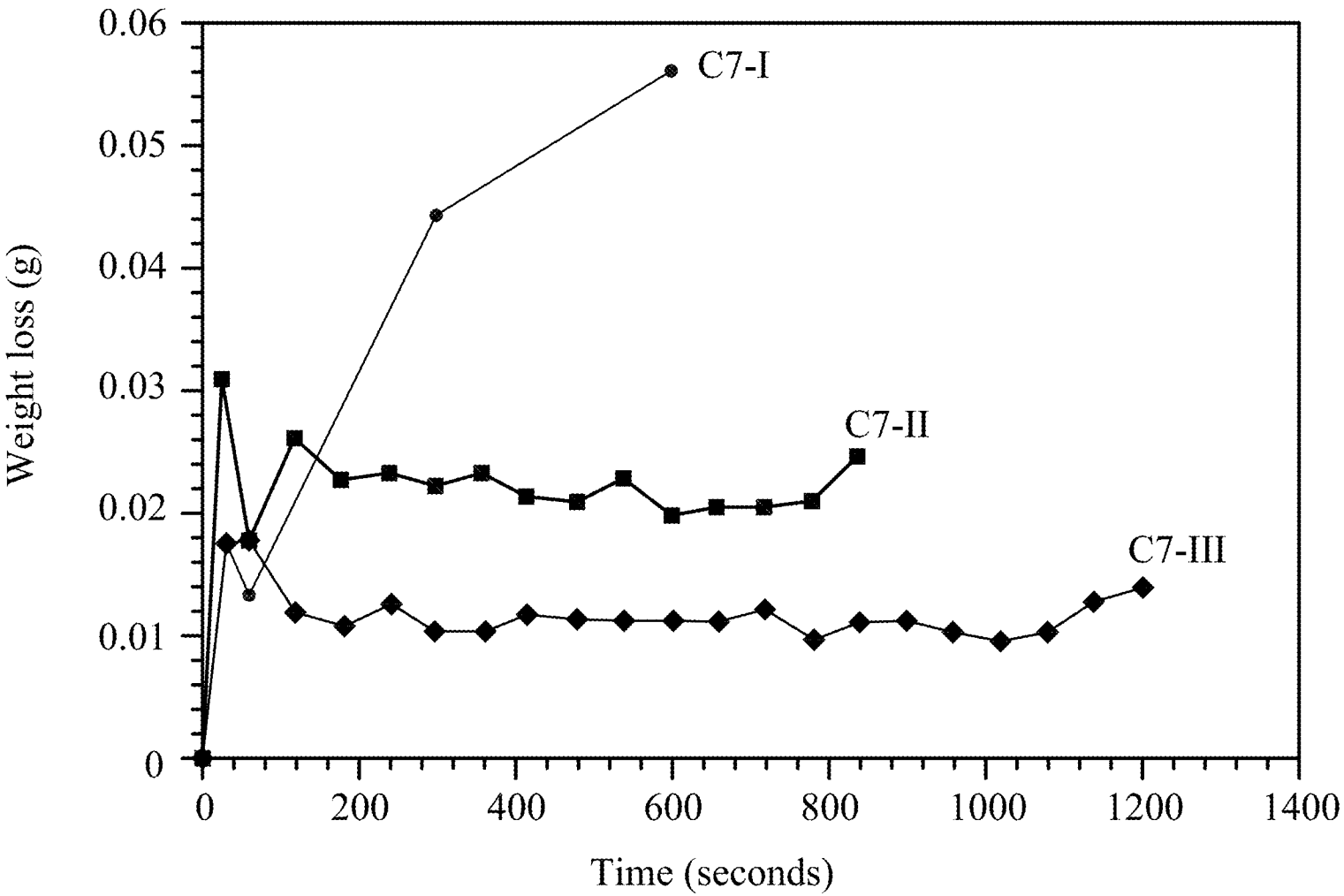

As shown in FIG. 2B, comparative embodiments 7-I to 7-III (C7-I to C7-III) and the six-component alloy of the embodiments of the present disclosure are all six-component alloy (FeNiCoCrAlSi). However, the atomic ratios of comparative embodiments 7-I to 7-III are different from that of embodiment 1 (E1), thus the time of abrasion until exposing the substrate for coatings of comparative embodiments 7-I to 7-III is about 1200 seconds at most. Moreover, as the aluminum content in the composition of a six-component alloy composition is increased, (for example, comparative embodiment 7-I has the highest aluminum content among the three comparative embodiments), the time of abrasion until exposing the substrate is greatly reduced accordingly. For example, the time of abrasion until exposing the substrate for the coating of comparative embodiment 7-I is merely about 600 seconds. It shows that when having the same combination of elements but without satisfying the ratios of elements according to the embodiments of the present disclosure, the six-component alloy coatings of comparative embodiments still cannot have good wear resistance.

As shown in FIG. 2A, for embodiment 1 (E1), the time of abrasion until exposing the substrate is the longest, which is 1620 seconds, and the volume lost by abrasion is the least, which is merely 27.16-34.06 $mm^3$. It shows that the multi-component alloy coating according to the embodiments of the present disclosure have good wear resistance.

High-temperature stability tests were performed on embodiment 1 (E1) and comparative embodiments 2 and 5 (C2 and C5). The composition of comparative embodiment 2 (C2) is as abovementioned. Comparative embodiment 5 (C5) is SKD61 steel. Bulk aluminum materials were placed on alloy coatings of embodiment 1 (E1) and comparative embodiment 2 (C2) and the bulk material of comparative embodiment 5 (C5), respectively, and then these three samples were heated at 700° C. for 30 minutes. Afterwards, the bulk aluminum materials placed on the three samples were removed, and thermal diffusion performance on surfaces of the two coatings of embodiment 1 (E1) and comparative embodiment 2 (C2) and the bulk material of comparative embodiment 5 (C5) were observed. Please refer to FIG. 3, which shows morphology of the alloy coatings and the bulk material after high-temperature treatments according to the embodiment and comparative embodiments of the present disclosure. The two pictures on the left side show two types of sample appearances of the heated bulk aluminum materials and the coatings of embodiment 1 (E1) and comparative embodiment 2 (C2). In each of the pictures, the object on the left side is the alloy coating, and the object on the right side is the removed heated bulk aluminum materials. The picture on the right side shows the sample appearance of the heated bulk aluminum material and the SKD61 steel of comparative embodiment 5 (C5). The object on the left side is the SKD61 steel, and the object on the right side is the removed heated bulk aluminum materials.

Figure 3:
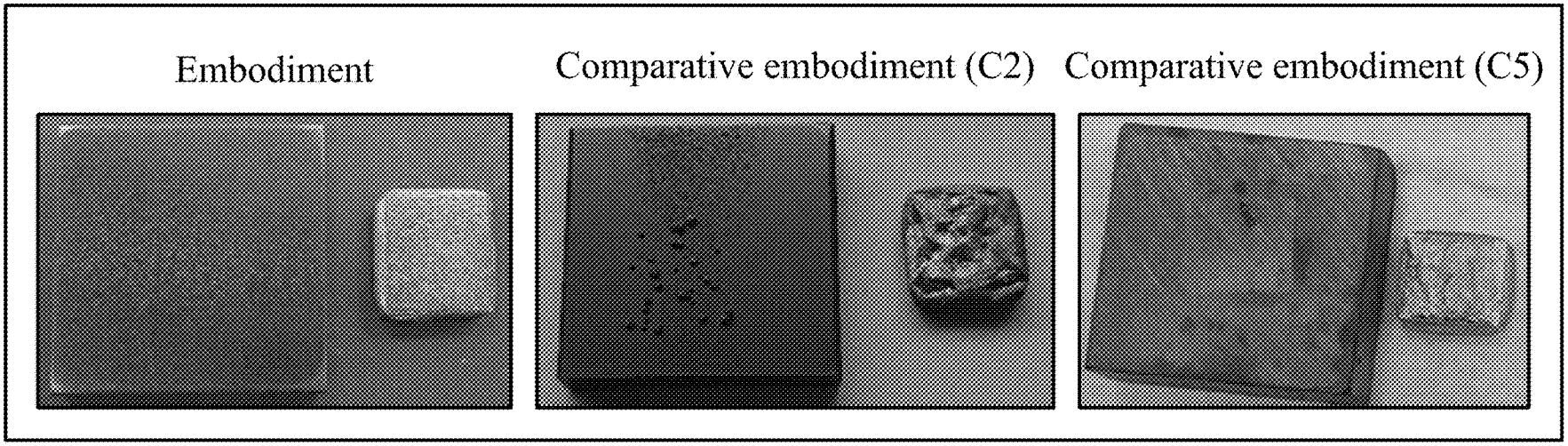
FIG. 3 shows morphology of alloy coatings after high-temperature treatments according to an embodiment and some comparative embodiments of the present disclosure.

As shown in FIG. 3, after the high-temperature treatment, bubbles were generated on the surface of the metal oxide-containing cobalt-based four-component alloy coating of comparative embodiment 2 (C2). It shows an obvious thermal diffusion between the surface and the bulk aluminum material. The high-temperature stability of the surface of the cobalt-based four-component alloy coating of comparative embodiment 2 (C2) is poor.

As shown in FIG. 3, after the high-temperature treatment, obvious recesses were formed on the surface of the SKD61 steel of comparative embodiment 5 (C5). It shows that the thermal diffusion between the surface and the bulk aluminum materials caused serious damage to the surface, thus the SKD61 steel of comparative embodiment 5 (C5) has a relatively poor high-temperature stability.

As shown in FIG. 3, after the high-temperature treatment, sticking phenomenon caused by thermal diffusion did not occur on the surface of the multicomponent alloy coating of embodiment 1 (E1), and the surface maintained a good condition. It shows that the multicomponent alloy coating according to the embodiments of the present disclosure has good high-temperature stability.

Figure 4A:
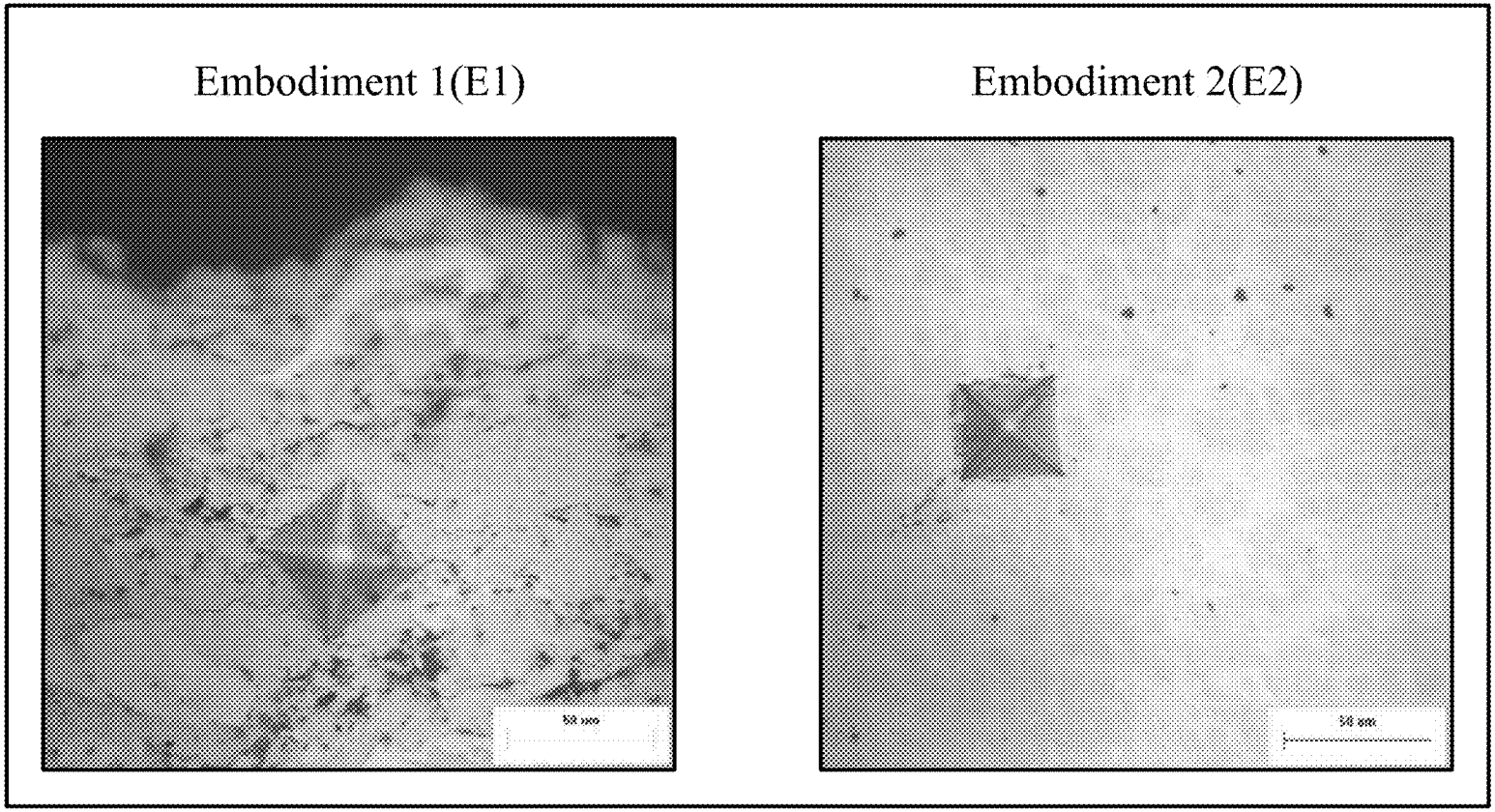
FIG. 4A shows morphology of an alloy coating and a bulk material after Vickers hardness tests according to some embodiments of the present disclosure.
Figure 4B:
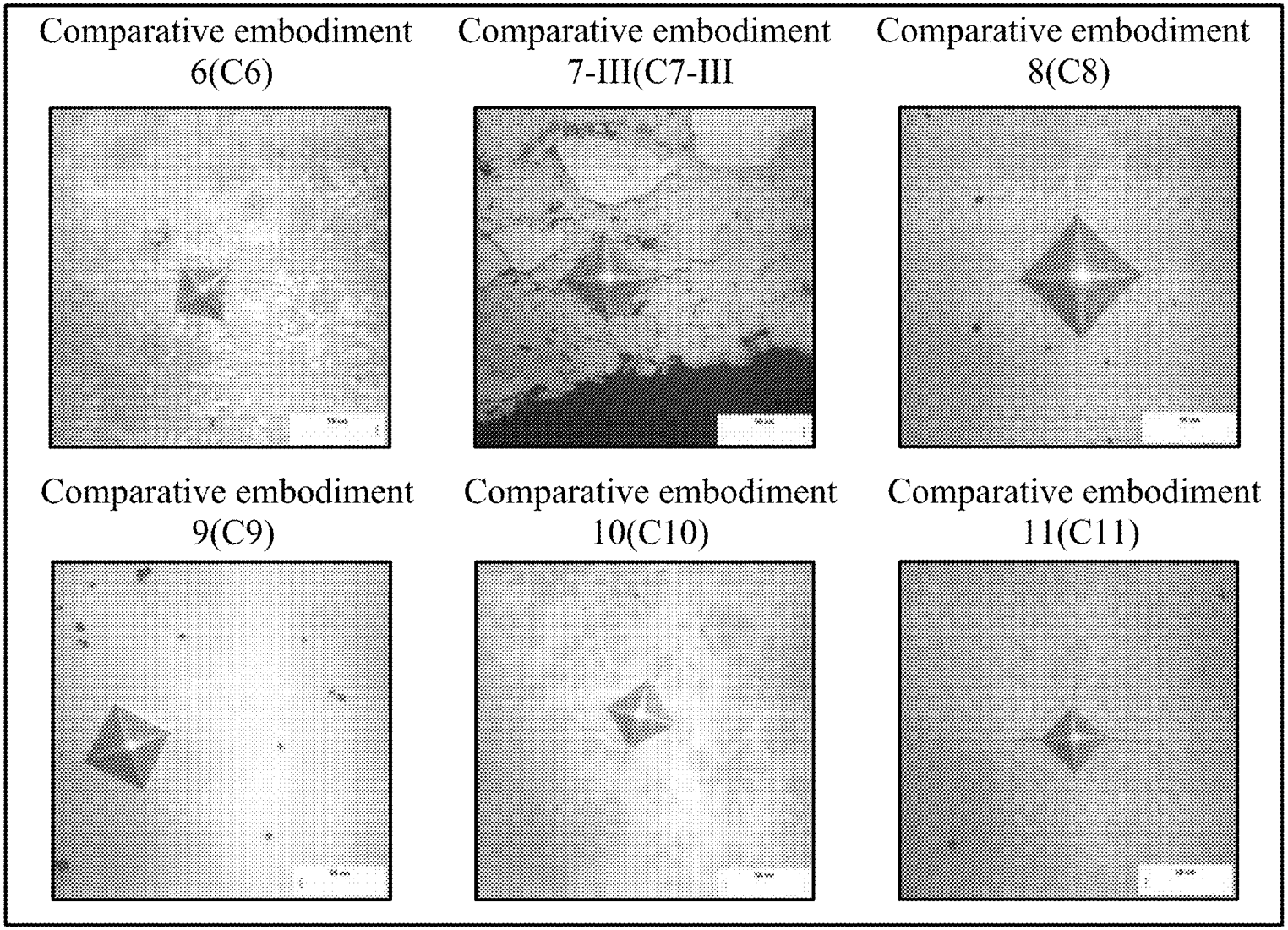
FIG. 4B shows morphology of alloy coatings and bulk materials after Vickers hardness tests according to some comparative embodiments of the present disclosure.

Please refer to FIGS. 4A-4B, FIG. 4A shows morphology of an alloy coating and a bulk material after Vickers hardness tests according to the embodiments of the present disclosure, and FIG. 4B shows morphology of alloy coatings and bulk materials after Vickers hardness tests according to the comparative embodiments of the present disclosure. The results of the Vickers hardness tests of the coating of embodiment 1 (E1), the bulk material of embodiment 2 (E2), and the bulk materials of comparative embodiments 6 to 11 (C6 to C11) are listed in table 3.

of iron, cobalt, chromium, and aluminum are greater than 0.4 and less than 0.5 with respect to 1 atomic ratio of nickel. Comparative embodiment 9 (C9) is also a five-component (FeNiCoCrAl) alloy bulk material, and the atomic ratio of each element is 1. Comparative embodiment 10 (C10) is a six-component (FeNiCoCrAlSi) alloy bulk material, and the atomic ratio of each element is 1. Comparative embodiment 11 (C11) is a seven-component (FeNiCoCrAlSiTi) alloy bulk material, and the atomic ratio of each element is 1. The five-component alloy materials of comparative embodiments 8 (C8) and 9 (C9) have high toughness, but the hardness is insufficient. The six-component and seven-component alloy materials of comparative embodiments 10 (C10) and 11 (C11) lose toughness due to too high hardness. Therefore, from the results of comparative embodiments 8-11 (C8-C11), it proves that the compositions and ratios of elements of embodiments 1 (E1) and embodiment 2 (E2) of the present disclosure have unique alloy properties meanwhile maintaining high hardness and toughness of alloy materials.

TABLE 3

| | E1 | E2 | C6 | C7-III | C8 | C9 | C10 | C11 |
|---|---|---|---|---|---|---|---|---|
| L1 (μm)[a] | ~57.5 | ~47 | ~44 | ~59.6 | ~80 | ~60 | ~46 | ~40 |
| L2 (μm)[b] | 10.71-50.77 | 0 | 11.76-14.77 | 28.74-90.02 | 0 | 0 | 7.51-17.6 | 31-44 |
| $Hv_1$[c] | 615 | 906 | 1049 | 591 | 291 | 610 | 1024 | 1026 |
| $Hv_{0.1}$[c] | 752 | 768.8 | 829 | 760.9 | 327.3 | 422.4 | 846.3 | 984.1 |
| $K_{IC}$[d] | 2.25 | NA | 3.30 | 1.16 | NA | NA | 3.30 | 1.81 |

[a]L1: diagonal length of a diamond-shaped indentation (μm);

[b]L2: length of fracture(μm);

[c]Hv: Vickers hardness;

[d]$K_{IC}$ (MPa · $m^{0.5}$, calculated from the elastic coefficient of $Al_2O_3$ E = 200 GPa).

Vickers hardness tests were performed on the coating of embodiment 1 (E1), the bulk material of embodiment 2 (E2), and the bulk materials of comparative embodiments 6 to 11 (C6 to C11). The test conditions were 1 kgf load for 25 seconds (represented as $Hv_1$) and 0.1 kgf load for 25 seconds (represented as $Hv_{0.1}$). The sizes of the bulk materials of comparative embodiment 6 (C6) and embodiment 2 (E2) are about 5-6 cm. Comparative embodiment 6 (C6) is a six-component (FeNiCoCrAlSi) alloy bulk material having atomic ratios different from that of embodiment 1 (E1), and each element is present in the amount of 3-35 wt %. Comparative embodiment 7-III (C7-III) is a six-component (FeNiCoCrAlSi) alloy coating having a composition and atomic ratios which are the same as that of comparative embodiment 6 (C6). Embodiments 2 (E2) is a six-component (FeNiCoCrAlSi) alloy bulk material having atomic ratios which are the same as that of embodiment 1 (E1) with iron present in the amount of less than 3 wt %. It can be seen that embodiment 1 (E1) and embodiment 2 (E2) are both fracture free. It indicates that the alloy materials having the elements and the ratios thereof according to the embodiments of the present disclosure can be provided with high hardness and toughness whether made into coatings or bulk materials.

Comparative embodiment 8 (C8) is a five-component (FeNiCoCrAl) alloy bulk material, wherein the atomic ratios As shown in table 3, the five-component alloy bulk material of comparative embodiment 8 (C8) does not have fracture, however, the hardness is too low to provide good wear resistance. In addition, as shown in table 3, the seven-component alloy coating of comparative embodiment 11 (C11) has high hardness, however, the length of fracture is too long and the fracture toughness is too low to provide too toughness.

As shown in FIG. 4B and table 3, the multicomponent alloy coating of comparative embodiment 7-III (C7-III) has a length of fracture of about 28.74-90.02 μm, and the diagonal length D1 of a diamond-shaped indentation is about 59.6 μm. However, as shown in FIG. 4A and table 3, for the multicomponent alloy coating of embodiment 1 (E1), the length of fracture of about 10.71-50.77 μm, the diagonal length of a diamond-shaped indentation is about 57.5 μm, and the Vickers hardness and the fracture toughness are relatively high. These indicate that the multicomponent alloy coating of the embodiments of the present disclosure has good wear resistance as well as good toughness.

Besides, table 4 and table 5 further list the results of measurements of other properties of embodiment 1 (E1) and comparative embodiments 8 and 11-12 (C8, C11-12). The compositions of comparative embodiments 8 (C8) and 11 (C11) are as previously mentioned, and comparative embodiment 12 (C12) is a 304SS steel.

TABLE 4

| | E1 | C8 | C11 | C12 |
|---|---|---|---|---|
| Water contact angle (degree) | 97 | 90.7 | 94.1 | 85.9 |

TABLE 5

| | E1 | C8 | C11 | C12 |
|---|---|---|---|---|
| Corrosion current ($A/cm^2$) | 4.26E−08 | 1.05E−07 | 4.23E−08 | 2.38E−07 |
| Corrosion potential (V) | −0.206 | −0.262 | −0.282 | −0.240 |

As shown in table 4, compared with comparative embodiments 8 and 11-12 (C8, C11-12), the multicomponent metal coating of embodiment 1 (E1) of the present disclosure has the highest water contact angle, and thus has a more hydrophobic surface.

As shown in table 5, compared with comparative embodiments 8 and 11-12 (C8, C11-12), embodiment 1 (E1) of the present disclosure has the second lowest corrosion current and the highest corrosion potential (the potential tends to be positive), and thus has a better corrosion resistance ability.

FIG. 5A to FIG. 5E show thermal analysis results of coatings according to the embodiments and comparative embodiments of the present disclosure. Embodiment 1 refers to the coating of embodiment 1 (E1), and comparative embodiment 13 (C13) is a four-component (CoCrAlY) alloy.

Figure 5A:
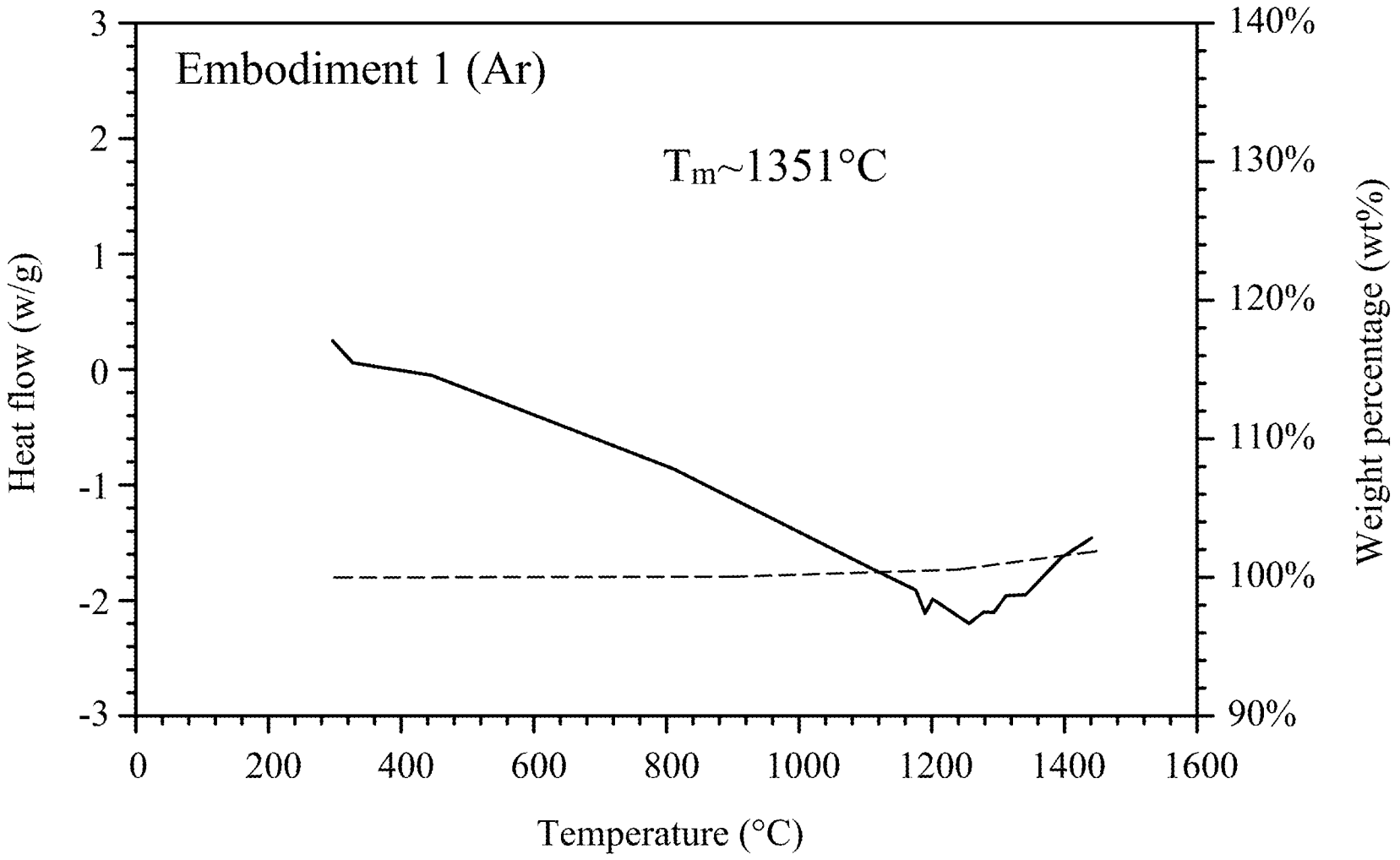
FIG. 5A to FIG. 5E show thermal analysis results of coatings according to some embodiments and some comparative embodiments of the present disclosure.
Figure 5B:
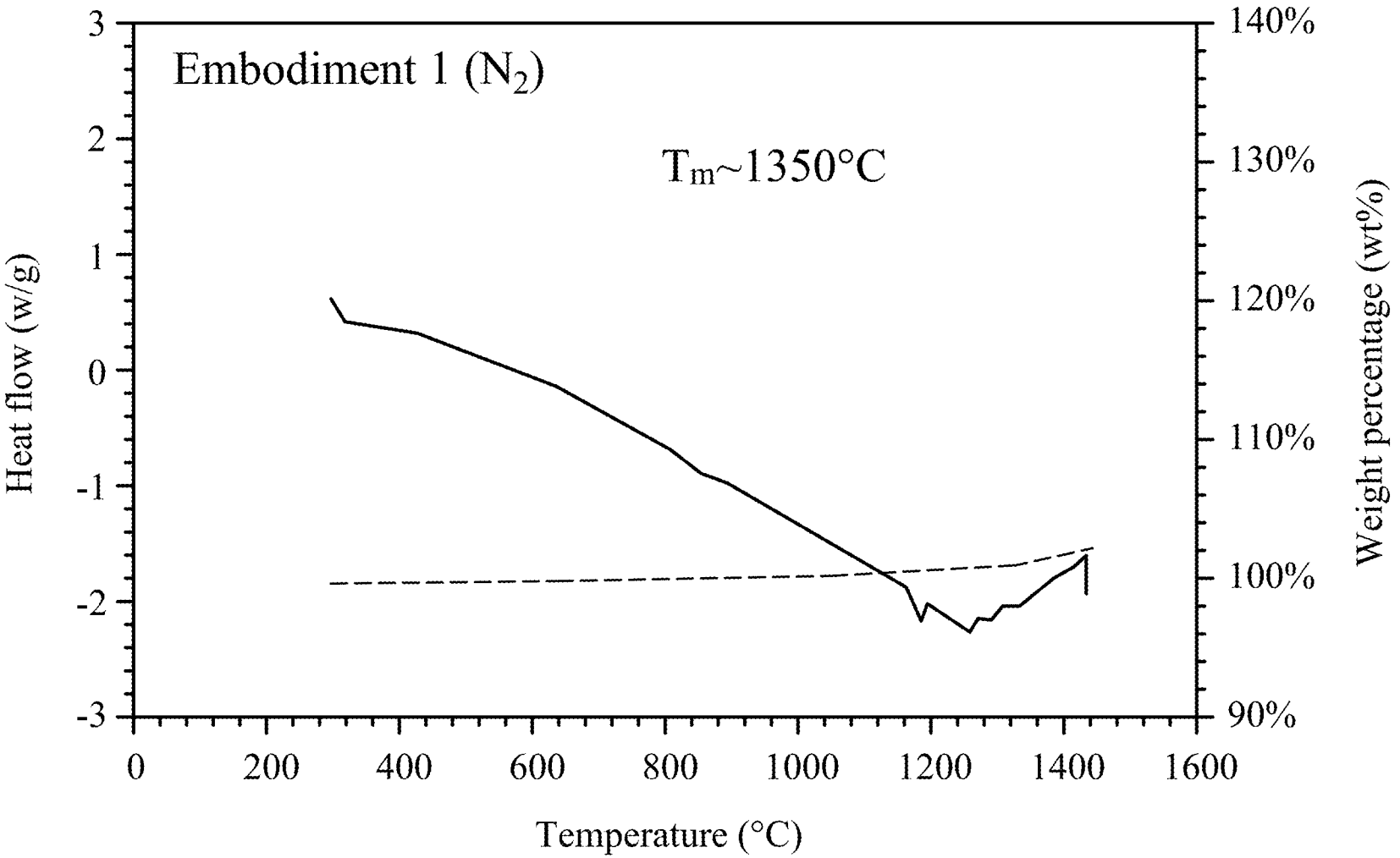
Figure 5C:
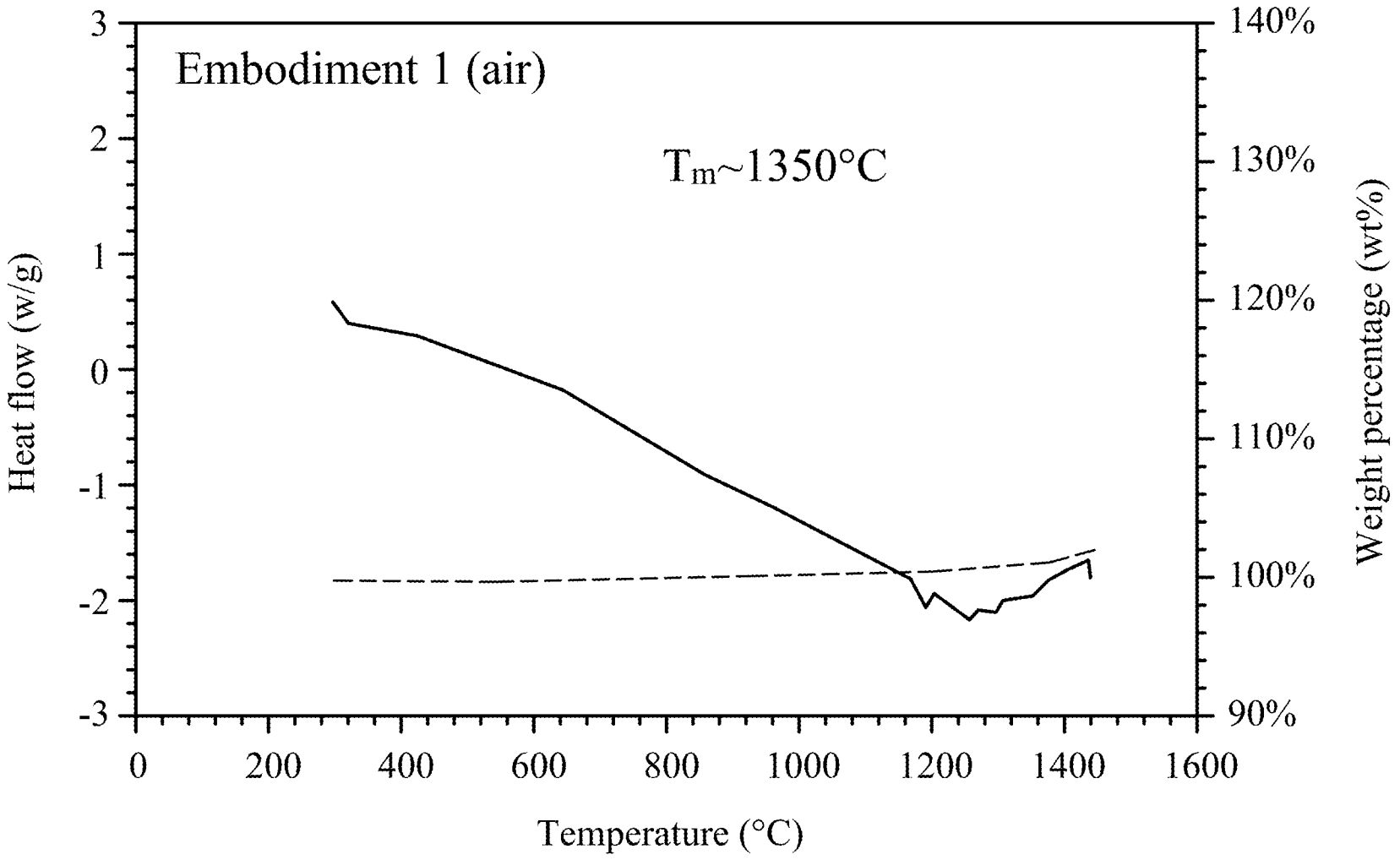
Figure 5D:
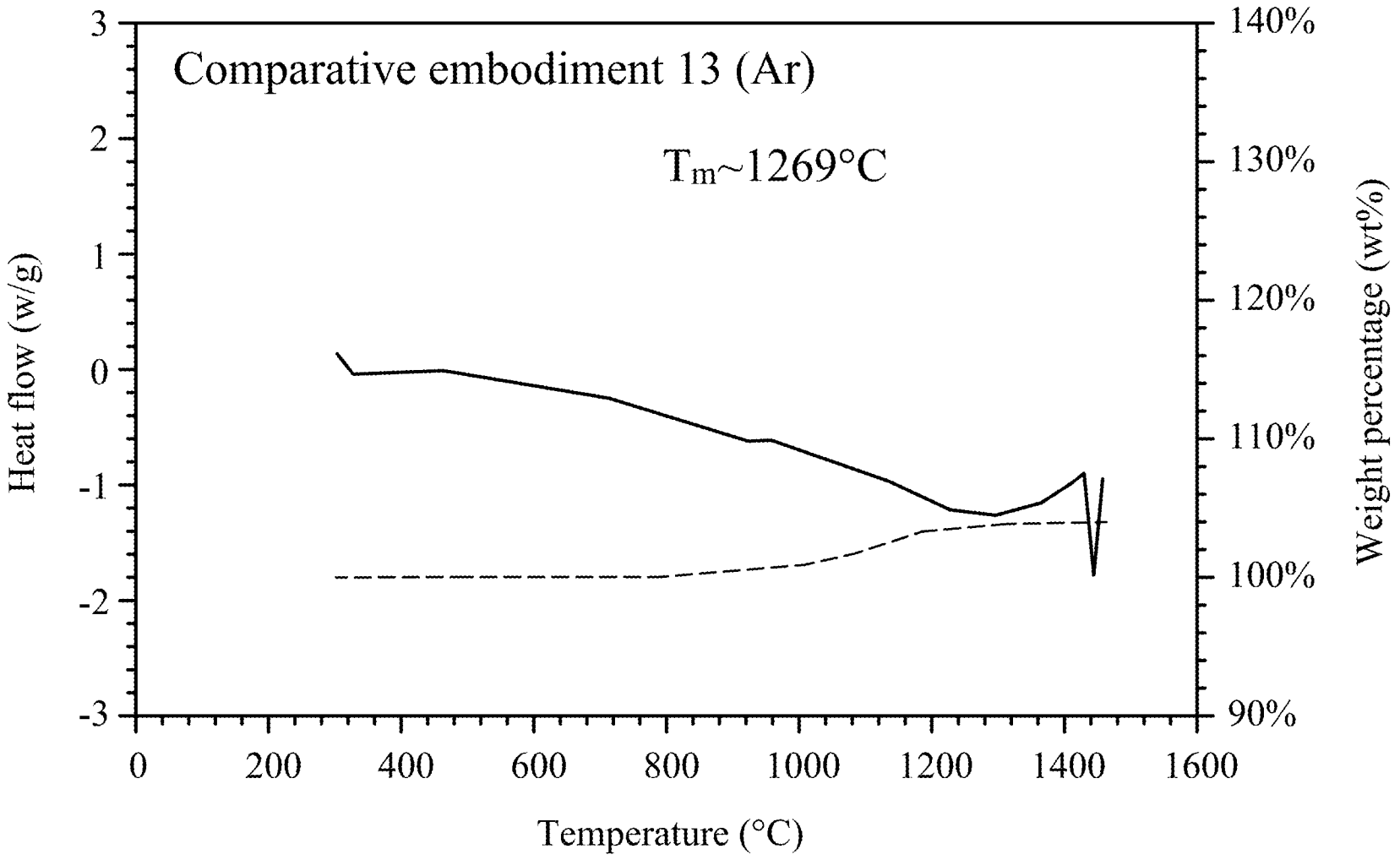
Figure 5E:
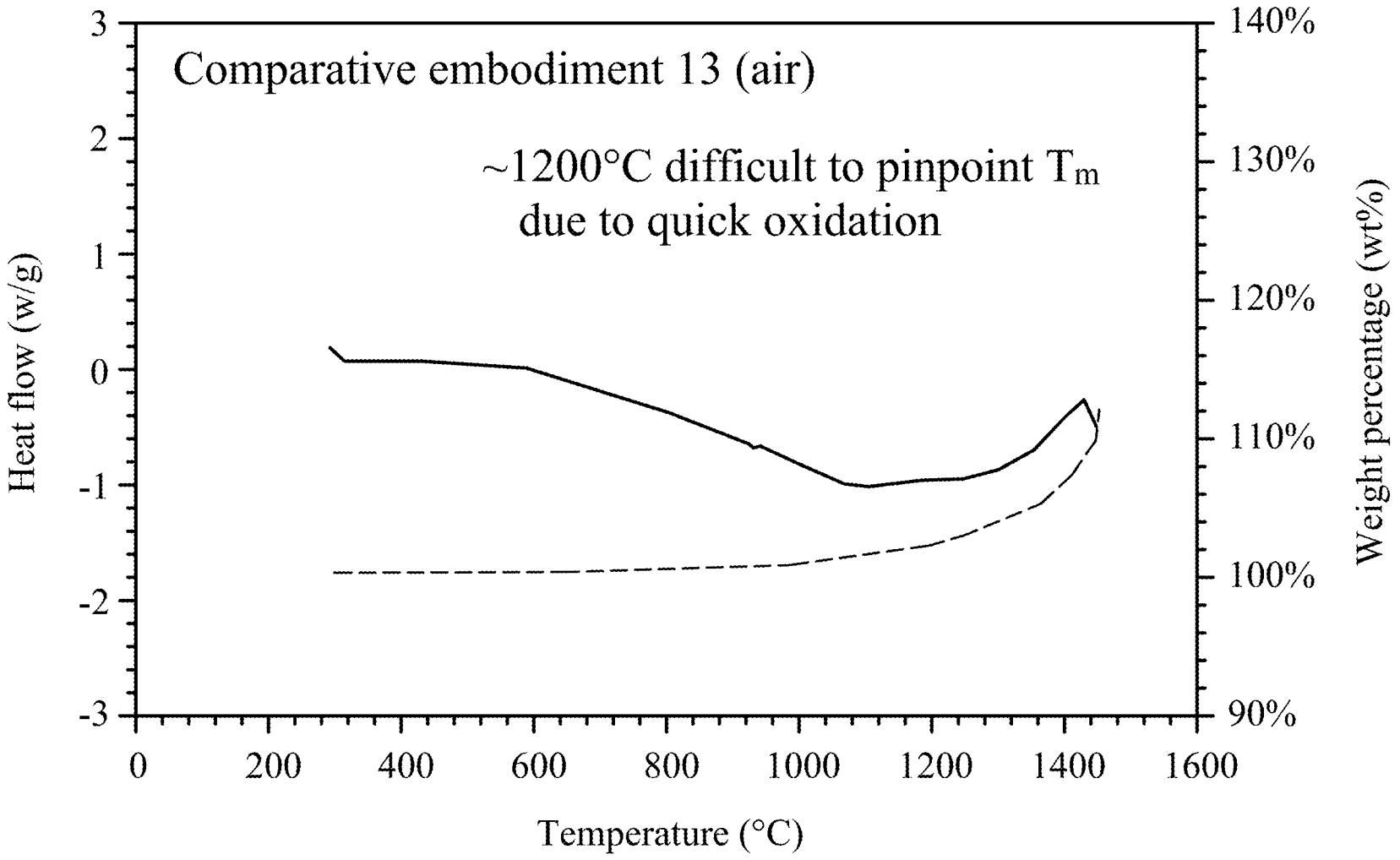

As shown in FIG. 5D and FIG. 5E, a melting point of 1269° C. of the four-component alloy of comparative embodiment 13 (C13) could be obtained only under an inert gas environment (Ar). When a thermal analysis of the four-component alloy of comparative embodiment 13 (C13) was performed in air, the exact melting point could not be measured due to quick oxidation starting from about 1200° C. It shows that the four-component alloy of comparative embodiment 13 (C13) does not have good high-temperature resistance.

In contrast, as shown in FIG. 5A to FIG. 5C, the value of the high melting point of the multicomponent metal coating of embodiment 1 (E1) can be exactly measured and obtained in air or under an inert gas environment (Ar and nitrogen), which are both about 1350° C. It indicates that the multicomponent metal coating of the embodiments of the present disclosure has good high-temperature resistance.

While the disclosure has been described by way of example and in terms of the exemplary embodiments, it should be understood that the disclosure is not limited thereto. On the contrary, it will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A multicomponent alloy coating, comprising:

a hard layer; and a plurality of nickel-based particles dispersed in the hard layer, wherein the composition of the nickel-based particles comprises nickel, aluminum, carbon and oxygen, wherein aluminum is present in a trace amount to 0.25 wt % of the composition of the nickel-based particles, nickel is present in the amount of greater than 94 wt % of the composition of the nickel-based particles, and carbon is present in the amount of greater than 5 wt % of the composition of the nickel-based particles; and wherein the composition of the multicomponent alloy coating is represented by the following formula (I):

$$Al_dCo_eCr_gFe_hNi_iSi_jC_kO_m \quad \text{formula (I)}$$

wherein $1<d<2$, $0.5<e<0.8$, $2<g<3.2$, $0.05<h<0.3$, $2<i<3$, $j=1$, $k\geq 0$, $m\geq 0$ in the formula (I), and iron is present in the amount of greater than 2 wt % and less than 3 wt % of the composition of the multicomponent alloy coating.

2. The multicomponent alloy coating according to claim 1, wherein nickel is present in the amount of greater than 30 wt % of the composition of the multicomponent alloy coating.

3. The multicomponent alloy coating according to claim 1, wherein aluminum is present in the amount of greater than 9 wt % of the composition of the multicomponent alloy coating.

4. The multicomponent alloy coating according to claim 1, wherein $2.5<k<4$ and $0.05<m<0.5$.

5. The multicomponent alloy coating according to claim 1, wherein carbon is present in the amount of greater than 0 wt % and less than 9 wt % of the composition of the multicomponent alloy coating.

6. The multicomponent alloy coating according to claim 1, wherein oxygen is present in the amount of greater than 0 wt % and less than 9 wt % of the composition of the multicomponent alloy coating.

7. The multicomponent alloy coating according to claim 1, wherein the composition of the multicomponent alloy coating comprises amorphous carbide.

8. The multicomponent alloy coating according to claim 1, wherein a weight ratio of the hard layer with respect to the nickel-based particles is 65:35 to 90:10.

9. The multicomponent alloy coating according to claim 1, wherein chromium is present in the amount of greater than 50 wt % of the composition of the hard layer.

10. The multicomponent alloy coating according to claim 1, wherein the nickel-based particles are present in the amount of greater than 9 vol. % of the multicomponent alloy coating.

11. The multicomponent alloy coating according to claim 1, wherein the multicomponent alloy coating has a porosity of 0.1%-2%.

* * * * *